US008104409B2

(12) United States Patent
Wolinski et al.

(10) Patent No.: US 8,104,409 B2
(45) Date of Patent: Jan. 31, 2012

(54) RAIL CAR SUSPENSION DAMPING

(75) Inventors: Joseph Wolinski, Metford (AU); Philip Edward Morris, Hamilton (AU)

(73) Assignee: Bradken Resources Pty Limited, Waratah NSW (AU)

( * ) Notice: Subject to any disclaimer, the term of this patent is extended or adjusted under 35 U.S.C. 154(b) by 312 days.

(21) Appl. No.: 12/194,518

(22) Filed: Aug. 19, 2008

(65) Prior Publication Data

US 2010/0043668 A1 Feb. 25, 2010

(51) Int. Cl.
*B61F 3/00* (2006.01)

(52) U.S. Cl. ..... 105/198.4; 105/182.1; 105/198.2

(58) Field of Classification Search ..... 105/182.1, 105/198.1–198.5
See application file for complete search history.

(56) References Cited

U.S. PATENT DOCUMENTS

| | | | | | |
|---|---|---|---|---|---|
| 2,352,693 | A * | 7/1944 | Davidson | 105/198.2 |
| 2,422,638 | A * | 6/1947 | Tucker | 105/198.2 |
| 2,723,630 | A * | 11/1955 | Settles | 105/198.2 |
| 3,079,873 | A * | 3/1963 | Tack et al. | 105/206.1 |
| 3,218,990 | A * | 11/1965 | Weber | 105/207 |
| 3,254,613 | A * | 6/1966 | Weber | 105/198.2 |
| 3,261,305 | A * | 7/1966 | Shafer | 105/198.2 |
| 3,450,063 | A * | 6/1969 | Shafer | 105/198.2 |
| 3,575,117 | A * | 4/1971 | Tack | 105/198.4 |
| 3,670,660 | A * | 6/1972 | Weber et al. | 105/171 |
| 3,927,621 | A * | 12/1975 | Skeltis et al. | 410/29 |
| 3,977,332 | A * | 8/1976 | Bullock | 105/198.4 |
| 4,574,708 | A * | 3/1986 | Solomon | 105/193 |
| 4,953,471 | A * | 9/1990 | Wronkiewicz et al. | 105/198.4 |
| 5,072,673 | A * | 12/1991 | Lienard | 105/198.2 |
| 5,511,489 | A * | 4/1996 | Bullock | 105/198.2 |
| 5,524,551 | A * | 6/1996 | Hawthorne et al. | 105/198.4 |
| 5,632,208 | A * | 5/1997 | Weber | 105/182.1 |
| 5,666,885 | A * | 9/1997 | Wike | 105/168 |
| 5,943,961 | A * | 8/1999 | Rudibaugh et al. | 105/198.2 |
| 6,688,236 | B2 * | 2/2004 | Taillon | 105/198.2 |
| 6,895,866 | B2 * | 5/2005 | Forbes | 105/197.05 |
| 7,174,837 | B2 * | 2/2007 | Berg et al. | 105/197.05 |
| 2002/0073880 | A1 * | 6/2002 | Wronkiewicz et al. | 105/182.1 |
| 2006/0180047 | A1 * | 8/2006 | Forbes | 105/182.1 |
| 2010/0043668 | A1 * | 2/2010 | Wolinski et al. | 105/198.4 |

FOREIGN PATENT DOCUMENTS

AU 495606 8/1977

(Continued)

OTHER PUBLICATIONS

By: Publication of American Steel Foundries, Title of Article: "ASF Trucks" Good for the Long Run, pp. 1-4, American Steel Foundries, printed in USA; date unknown.

*Primary Examiner* — Joe Morano, IV
*Assistant Examiner* — Jason C Smith
(74) *Attorney, Agent, or Firm* — Kenyon & Kenyon LLP

(57) ABSTRACT

A freight rail car suspension has independent but co-operating springs; a first spring is load carrying and has a variable damping function and a second control spring operates on a friction shoe to apply a constant damping component. A practical embodiment has a friction shoe engaged for vertical displacement by the first spring which is mounted on a side frame and the second spring is obliquely arranged between the bolster of the bogie and the friction shoe, which has guides to cause it to move into greater frictional engagement upon load being applied through the spring. This arrangement provides a dual damping characteristic involving both constant damping and variable damping forces.

23 Claims, 6 Drawing Sheets

FOREIGN PATENT DOCUMENTS

| | | | |
|---|---|---|---|
| AU | 199215060 | | 9/1993 |
| AU | 199212401 | | 1/1995 |
| AU | 199674002 | A1 | 6/1997 |
| AU | 2004201919 | A1 | 1/2005 |
| WO | WO 2006/072800 | A1 | 7/2006 |

* cited by examiner

RAIL CAR SUSPENSION DAMPING

The present invention relates to suspensions for rail cars and in particular is concerned with a resilient damping system for use in bogies (or trucks) wherein a pivotal bolster extends between side frames and a resilient suspension is located between the bolster and each of the side frames.

There is a very great difference between the total weight of a freight rail car between its unloaded and loaded conditions. Typically the tare of a rail car is of the order of 20 tons and the car when fully loaded may be of the order of 120 tons. The design of the suspension can readily focus on carrying the loads effectively in either a loaded condition or an unloaded condition or some compromise may be reached, but the challenge is to provide an effective damping to the suspension when operating empty or loaded.

Generally designs are either based on constant damping or variable damping. Typically each bogie comprises a transversely extending bolster (on which the rail car body is pivotally mounted) and a pair of side frames mounting wheels (interconnected by axles)in suitable bearings. A spring suspension mounts the bolster on the side frames. Typically the suspension on each side frame comprises a multiplicity of parallel helical load springs together with damping springs supporting friction shoes (which are usually wedge shaped) and which transmit load from the damping springs to the friction shoe to urge its surface onto a vertical friction wear plate mounted on the bolster.

The design of the damping springs determines the damping effect to attenuate displacement of the side frames relative to the bolster. One approach is constant damping where the static column load does not vary with deflection.

Thus, with constant damping, the restoring force is constant with displacement in the system and when designed to suit the unloaded weight of the vehicle this can provide good performance in that configuration but is problematical when the vehicle is loaded, despite the designer seeking to select springs of appropriate performance and rating.

An alternative is a variable damping suspension where the restoring force varies with displacement. Such an approach is believed to be particularly useful for loaded vehicles operating at the loaded rating. However, when the vehicle is unloaded the system is problematical. Since empty rail cars often travel at greater speeds, an unsuitable damping system is a problem and instability, with consequent adverse wear on the railcars and the track, is likely.

Broadly the present invention is based on the concept of having separate independent but co-operating resilient systems to provide a blend of variable damping and constant damping.

In one aspect the present invention relies on the appreciation of using a dual system having a first resilient system essentially in a substantially variable damping mode, and a second independent resilient system in co-operating arrangement providing substantially constant damping. In practice though the range of loaded to empty the damping can vary from principally a variable damping component and a minor constant damping component to principally a constant damping component and a minor variable damping component.

In another aspect, the present invention may be considered as directed to a suspension system for a rail car bogie having a transverse bolster and side frames, the suspension system comprising a first resilient structure with a line of action for damping movement and acting between a side frame and a friction shoe which engages the line of action of the first resilient structure being the bolster along a first axis, and a second resilient structure acting independently of the first resilient structure between the bolster and the friction shoe for providing damping, the second resilient structure acting on a second axis arranged at an acute angle to the first axis.

In one embodiment, the first axis can be arranged substantially vertically and the second axis at an angle of about 30 degrees to about 40 degrees to the horizontal. Such systems can be arranged to provide dual damping functions i.e. a combination of inherently variable damping and constant damping components.

Conveniently the embodiment may be implemented using a first helical compression spring for mounting along the first axis and a second helical compression spring for mounting along the second axis.

Embodiments of the invention can be implemented in many ways and for example may offer the advantage of avoiding weakening the bolster as there is no need to provide a hole through the bolster and generally embodiments can be simpler to maintain than alternatives.

For illustrative purposes an embodiment of the invention will now be described with reference to the accompanying drawings, of which FIG. 1 is an isometric cut-away view of an embodiment of the invention partially assembled, the side frame being partially sectioned and the bolster being partially sectioned;

Figure 1:
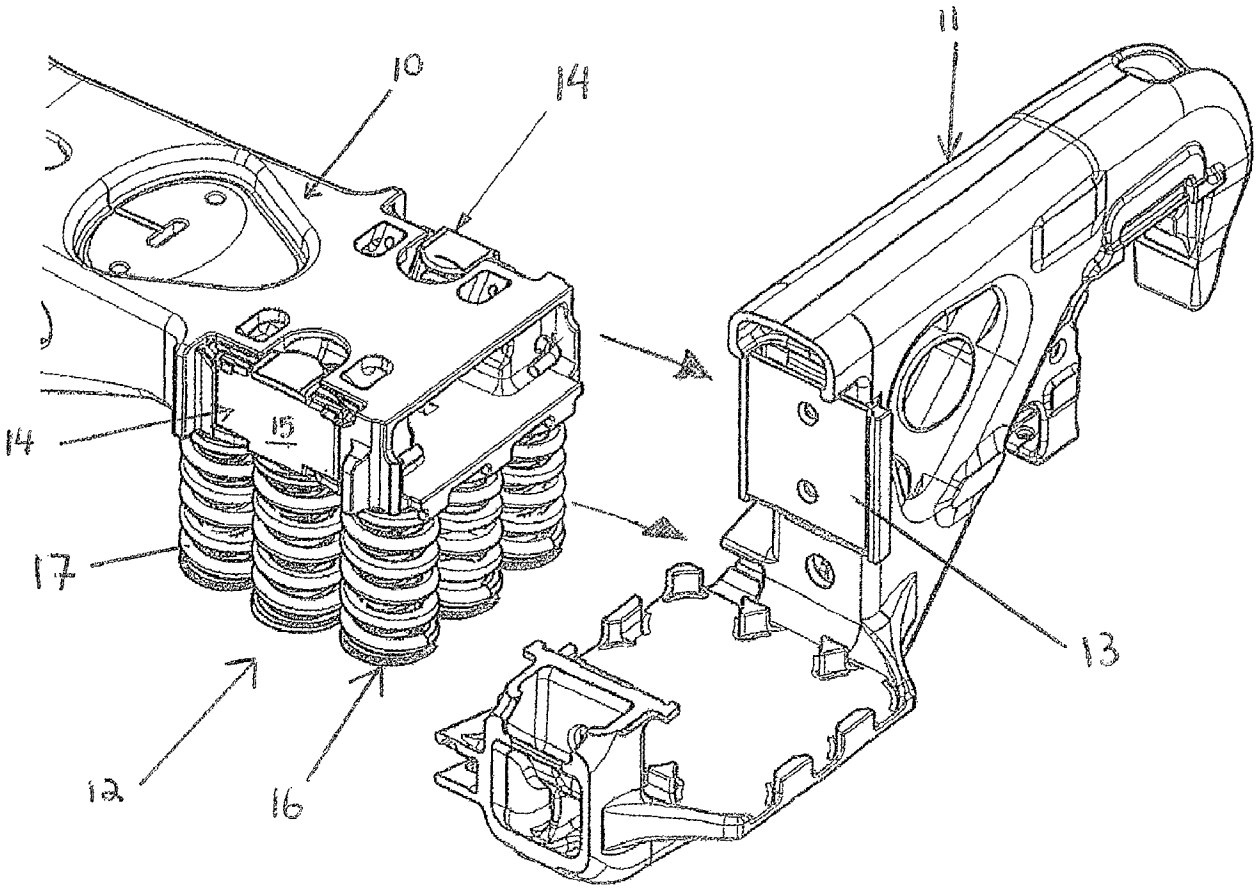
Figure 2:
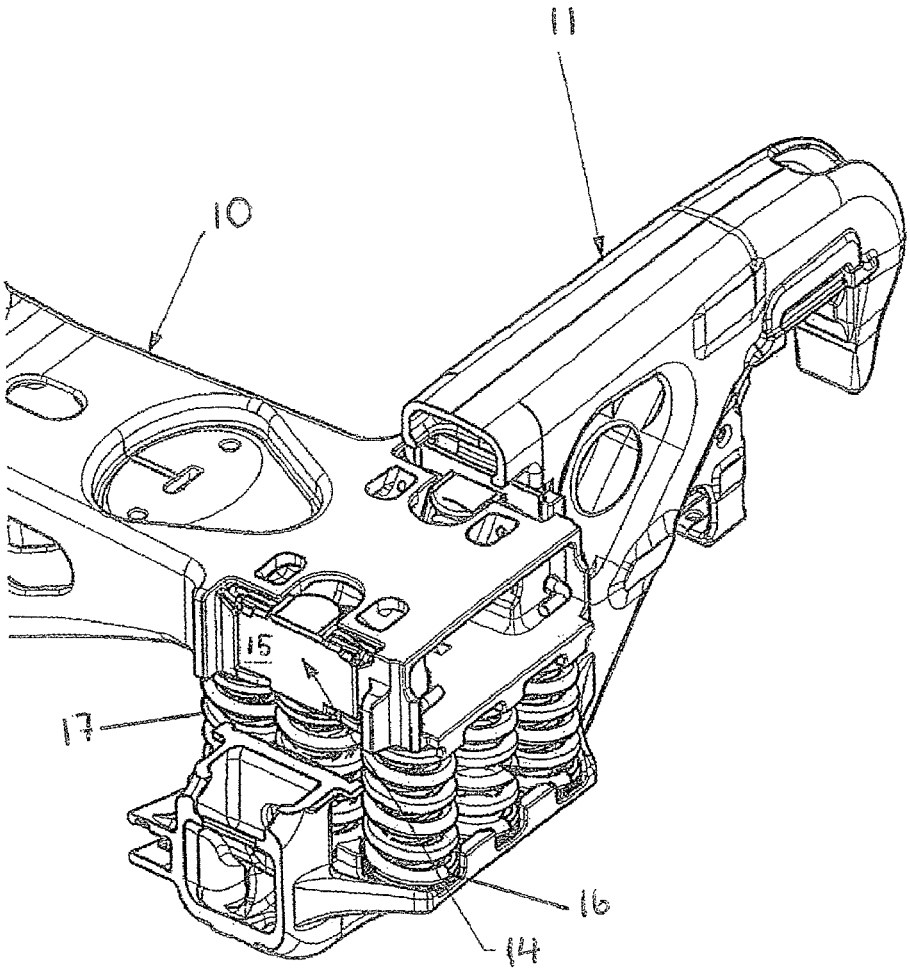
FIG. 2 is a view of the embodiment of FIG. 1 when assembled in a similar partially cut-away form.

A railcar bogie comprises a pair of side frames connected to a bolster through respective spring suspension systems, the bolster being adapted to mount a railcar through a central pivotal mounting not shown in the drawings. At each end, each side frame mounts a wheel in a bearing the respective pairs of wheels being interconnected by axles. FIG. 1 shows an embodiment in which the bolster 10 is disposed for interconnection with a side frame 11 through a suspension system 12. The side frame mounts a pair of vertical wear plates 13 which confront respective sliding friction shoes 14 mounted in the bolster such that the resiliently applied force through a friction face 15 provides a damping function for the suspension.

In this case the suspension comprises a total of 9 spring elements with an outer line 16 comprising helical load compression springs and an inner line 17 comprising a similar line of load compression springs. The matrix of springs includes a centre spring 18 most clearly shown in FIG. 6 and in this embodiment comprising a smaller helical spring located within a larger helical spring to act in concert in resiliently supporting a load between the bolster and the side frame.

Figure 3:
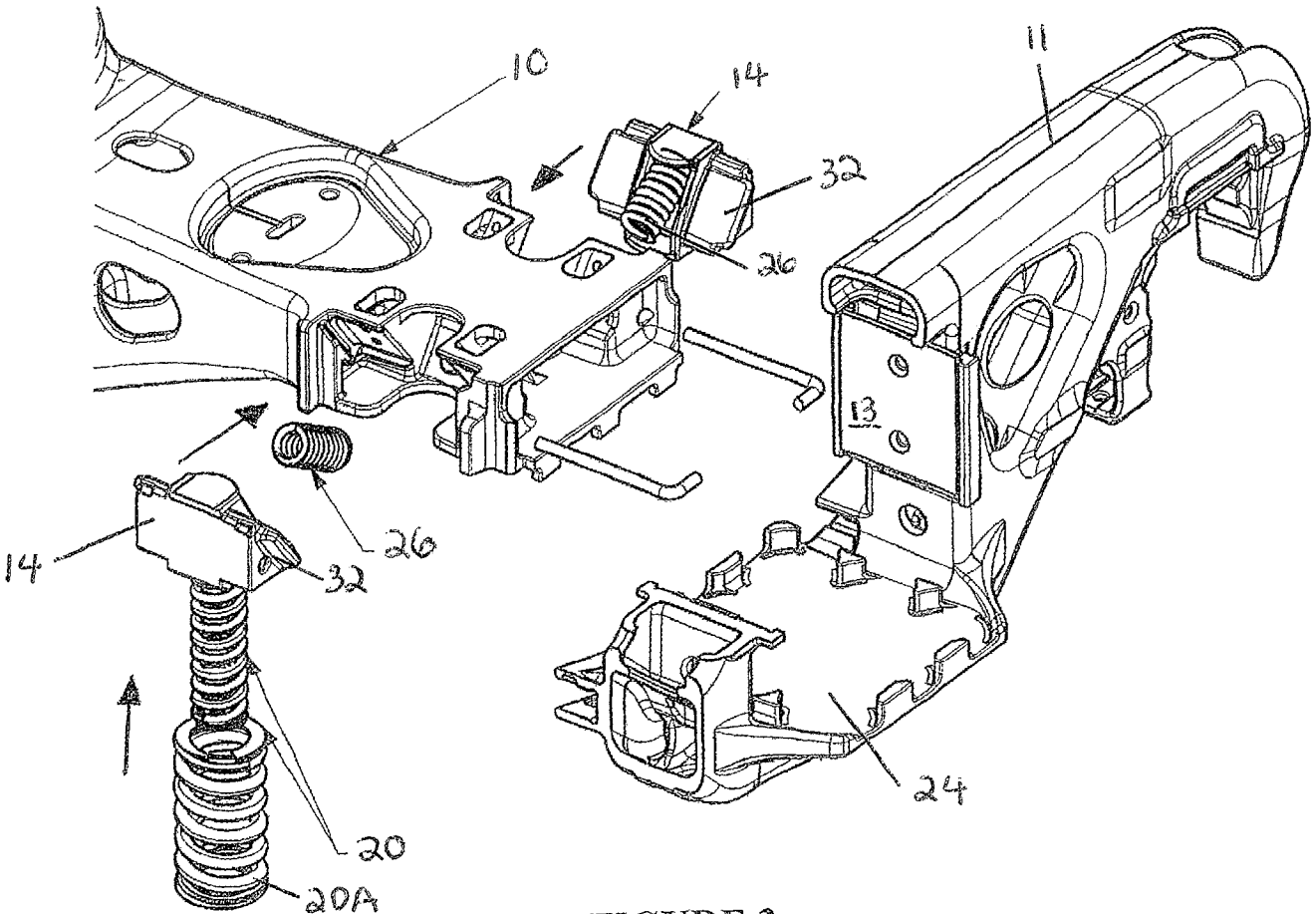
FIG. 3 is an exploded view of the embodiment of FIGS. 1 and 2 showing principal components of the dual damping spring arrangement applied to the respective friction shoes.
Figure 4:
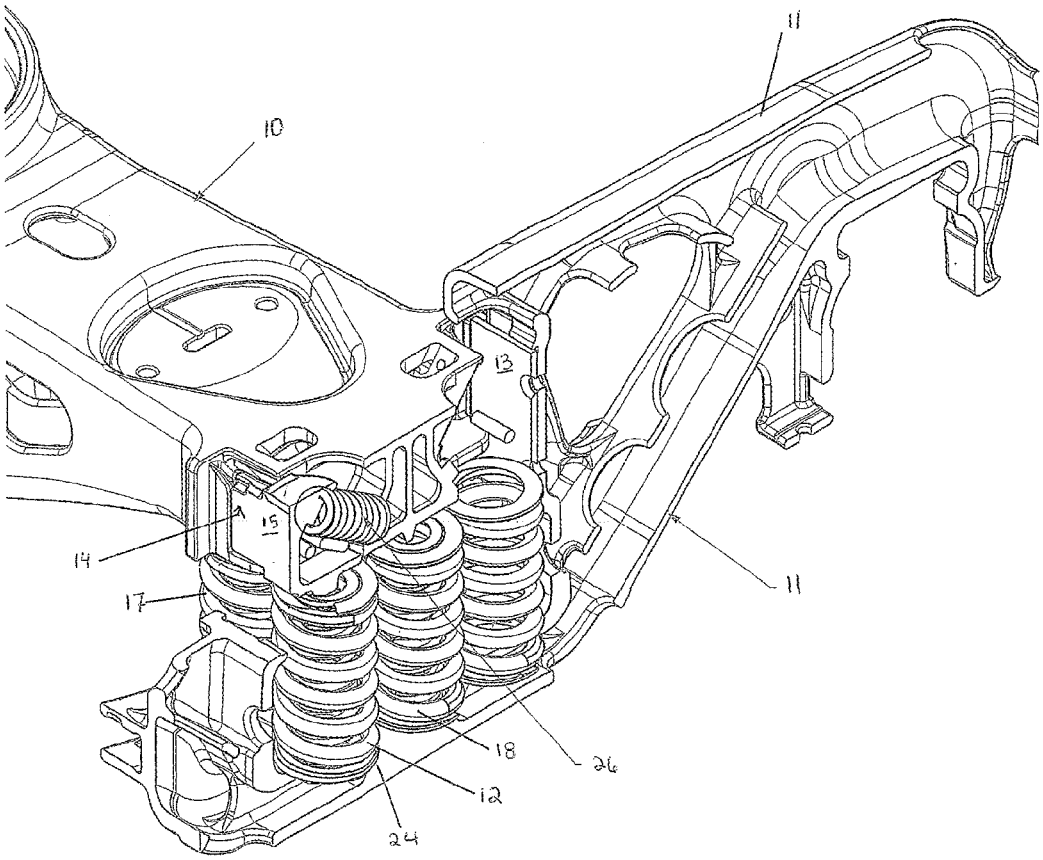
FIG. 4 is an assembled view showing the components in part with the side frame sectioned longitudinally through its central plane and the bolster being transversely sectioned in the same central plane of the side frame.
Figure 5:
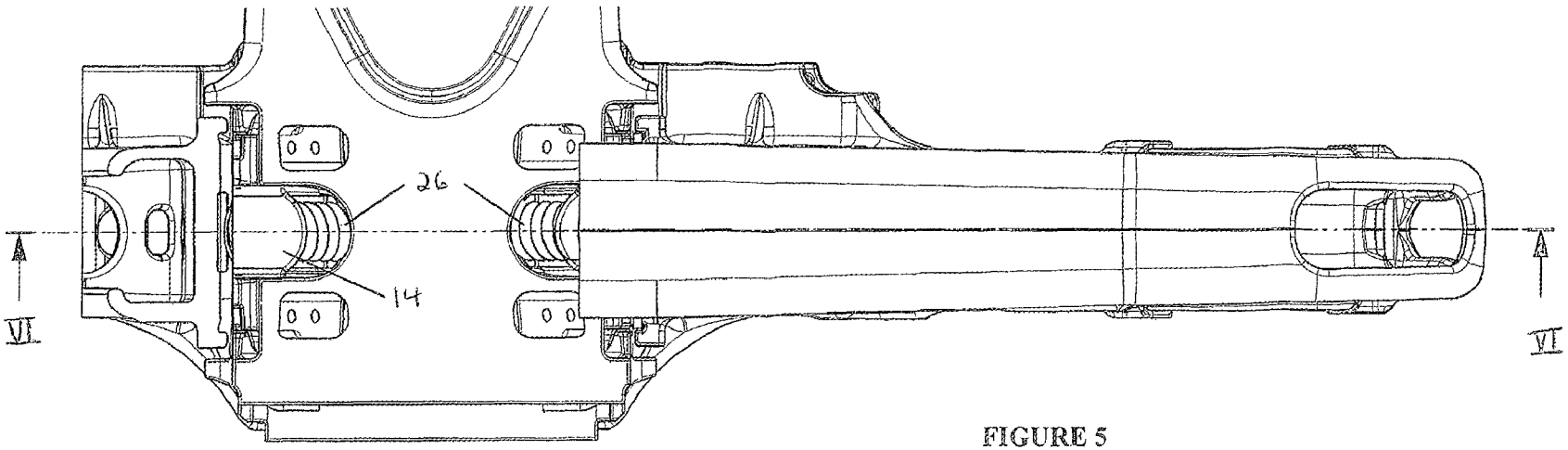
FIG. 5 is a plan of the embodiment of FIG. 1 assembled.
Figure 6:
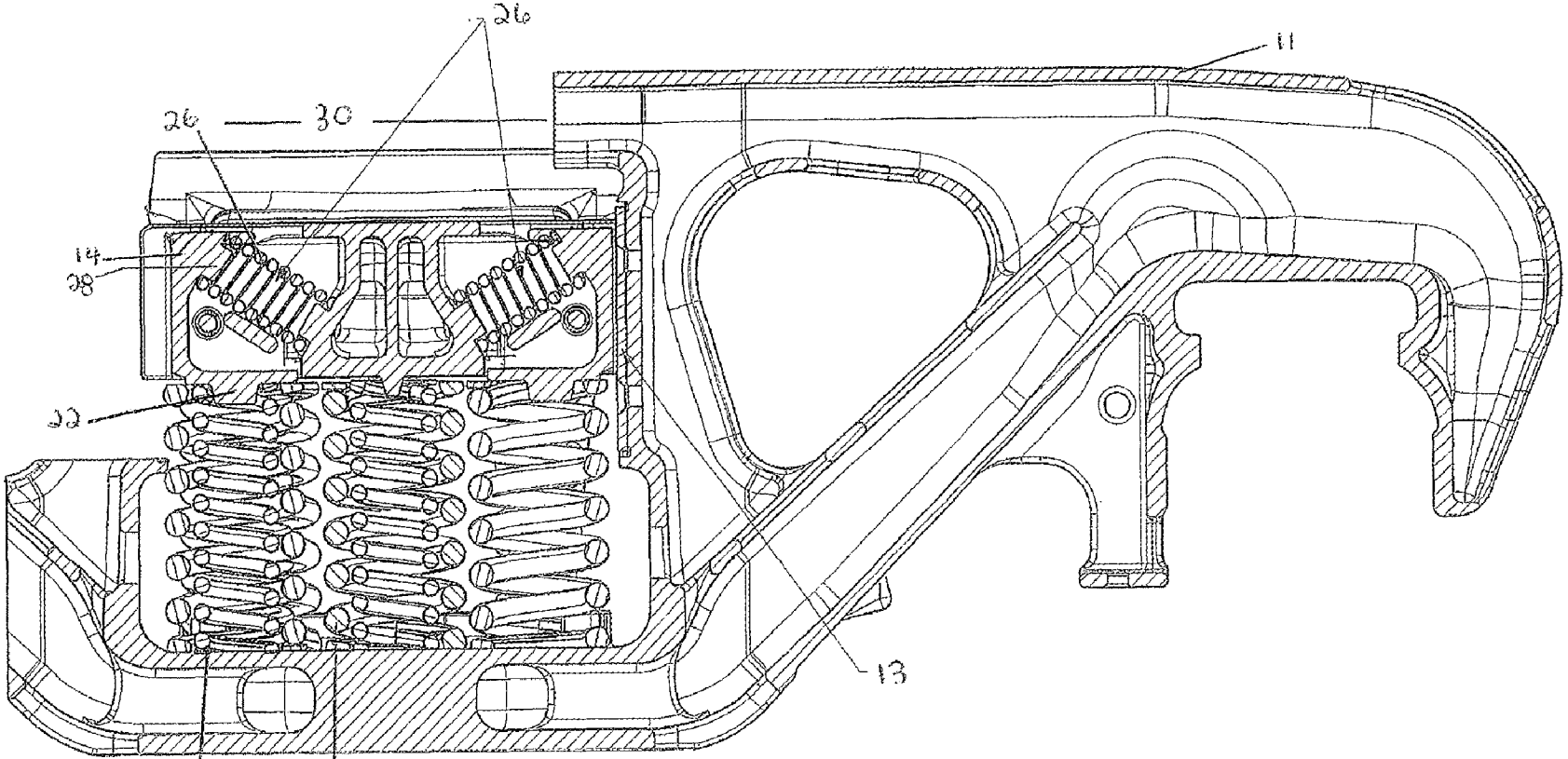
FIG. 6 is a longitudinal sectional view through the side frame along the line VI-VI of FIG. 5.

FIG. 3 in an exploded view which shows a variable load spring 20 for each shoe 14 and comprising a larger diameter outer spring 20A and a smaller diameter inner spring 20B, the springs being seated, as most conveniently shown in FIG. 6 between a base 22 of the shoe 14 and an support surface 24 in the side frame. This spring 20 is a variable load spring and provides a variable damping component to the overall suspension system by virtue of upward pressure under load on the shoe 14.

The shoe is also resiliently supported for receiving a constant damping force by a constant load control spring 26. As best shown in FIG. 6, the shoe has an angled interior portion 28 providing a boss for locating the upper end of the control spring and the lower end of the control spring is located over a confronting portion 30 formed in the bolster and thus guiding the shoe that its movement is confined to movement along a path at an angle of about 35 degrees to the horizontal.

When load is applied to the rail car, the bolster under load depresses the main load control springs and moves relatively downward to the side frame in a conventional manner. In a known variable control system a variable control spring such as 24 engages on the base of a wedge shaped friction shoe in a manner similar to that shown in the drawings but in the present embodiment there is the addition of the obliquely arranged constant load control spring 26.

This configuration thus provides two spring influences on the friction shoe and force from each spring urges the shoe to engage with a corresponding load on the vertical wear plate 13 on the side frame.

Embodiments of the invention will use suitably selected spring characteristics for the installation intended and its load carrying capacities. Typically the tare of a freight rail car is of the order of 20 tons but the fully loaded weight may well be of the order of 120 tons. Typically the spring characteristics and dimensions will be chosen such that in a tare condition principally the damping function component of force on each friction shoe is of the order of 70% to 80% of the total damping component from the constant load control spring 26 and the balance, a minority of the total component, is from the variable load spring 24. By contrast in the heavily laden condition, the springs are such that the reverse is the case and the constant load control spring contributes only 20% to 30% of the component total of force applied for damping and the balance is provided by the variable load spring.

Generally embodiments are intended to be implemented where at tare damping steadily increases with the load on the column from a tare condition to a fully laden condition.

It is believed this approach avoids the somewhat unsatisfactory compromise in known systems of either constant control or variable control of damping and in a practical and effective engineering arrangement permits effectively a dual damping phenomenon with variation in the damping through the load range to occur. If there is not appropriate damping of the spring suspension of a rail car in a particular condition, then the consequence can be instability of the cars as they travel in a railway system resulting in excessive wear of both the track and the bogie structure.

The claims defining the invention are as follows:

1. A suspension damping system for a railway bogie supporting a railcar comprising:

a first resilient system providing a variable damping component to the suspension damping system, wherein the variable damping component is dependent on a load supported by the railway bogie; and a second resilient system providing a constant damping component to the suspension damping system, wherein when the railcar is in an unloaded condition, the constant damping component is greater than the variable damping component, and in a fully loaded condition, the variable damping component is greater than the constant damping component.

2. A suspension system according to claim 1 wherein the first resilient system comprises a first resilient structure with a line of action along a first axis; and the second resilient system comprising a second resilient structure with a line of action along a second axis arranged at an acute angle with respect to the first axis.

3. The suspension system according to claim 2, wherein the first axis is arranged substantially vertically and the second axis is arranged at an oblique angle.

4. The suspension system according to claim 3, wherein the oblique angle is about 30 degrees to 40 degrees to horizontal.

5. The suspension according to claim 2, wherein the first resilient structure comprises a compression spring for mounting along the first axis and the second resilient structure comprises a second compression spring for mounting along the second axis.

6. The suspension system according to claim 2, further comprising a housing in which the friction shoe locates, the friction shoe and the housing having cooperative engaging surfaces that guide the movement of the friction shoe relative to the housing into engagement with the friction surface under the biasing force of the first and second resilient system.

7. The suspension according to claim 6, wherein the friction shoe is guided to move substantially along the second axis.

8. The suspension according to claim 6, wherein the housing forms part of a bolster of the railcar.

9. A suspension damping system for a railway bogie supporting a railcar comprising:

a friction shoe that engages a friction surface to provide damping to the suspension of the railcar;

a first resilient system that is operative to impart a biasing force to the friction shoe to bias the friction shoe into frictional engagement with the friction surface; and a second resilient system that is operative to impart a biasing force to the friction shoe to bias the friction shoe into frictional engagement with the friction surface independently of the first resilient system; wherein the biasing force imparted by the first resilient system varies depending on the loading condition of the railcar to provide a variable damping component to the suspension damping system, whereas the biasing force imparted by the second resilient system is substantially constant and not dependent on the loading condition of the railcar to provide a constant damping component to the suspension damping system;

wherein when the railcar is in an unloaded condition, the constant damping component is greater than the variable damping component, and in a fully loaded condition, the variable damping component is greater than the constant damping component.

10. A railcar bogie comprising;

a bolster;

at least one wheel-mounting side frame;

a resilient damped suspension system connecting the at least one side frame to the bolster, wherein the suspension system comprises:

a friction surface disposed on the side frame;

a friction shoe displaceably mounted in the bolster for displacement to allow frictional engagement of the friction shoe with the friction surface to provide damping to the suspension system;

a first resilient system acting between the side frame and the friction shoe; and a second resilient system acting between the bolster and the friction shoe, each of the first and second resilient systems being operative to impart a biasing force to the friction shoe bias the friction shoe into engagement with the friction surface.

11. The railcar bogie according to claim 10, wherein the biasing force imparted by the first resilient system varies depending on the loading condition of the railcar to provide a variable damping component to the suspension system, whereas the biasing force imparted by the second resilient system is substantially constant and not dependent on the loading condition of the railcar to provide a constant damping component to the suspension system.

12. A railcar bogie comprising;

a bolster;

at least one wheel-mounting side frame; and a resilient damped suspension system connecting the at least one side frame to the bolster, wherein the suspension system comprises:

a friction surface disposed on the side frame;

a friction shoe displaceably mounted in the bolster for displacement to allow frictional engagement of the friction shoe with the friction surface to provide damping to the suspension system;

a first resilient system acting between the side frame and the friction shoe; and a second resilient system acting between the bolster and the friction shoe, each of the first and second resilient systems being operative to impart a biasing force to the friction shoe to bias the friction shoe into engagement with the friction surface;

wherein the biasing force imparted by the first resilient system varies depending on the loading condition of the railcar to provide a variable damping component to the suspension system, whereas the biasing force imparted by the second resilient system is substantially constant and not dependent on the loading condition of the railcar to provide a constant damping component to the suspension system; and wherein when the railcar is in an unloaded condition, the constant damping component is greater than the variable damping component, and in a fully loaded condition, the variable damping component is greater than the constant damping component.

13. The railcar bogie according to claim 12, wherein the first resilient system comprises a first resilient structure with a line of action along a first axis; and the second resilient system comprises a second resilient structure with a line of action along a second axis arranged at an acute angle to the first axis.

14. The railcar bogie according to claim 13, wherein the first axis is arranged substantially vertically and the second axis is arranged at an oblique angle.

15. The railcar bogie according to claim 14, wherein the oblique angle is about 30 degrees to 40 degrees with respect to horizontal.

16. The railcar bogie according to claim 13, wherein the first resilient structure comprises a compression spring for mounting along the first axis and the second resilient structure comprises a second compression spring for mounting along the second axis.

17. The railcar bogie according to claim 16, wherein the compression spring of the first resilient structure compresses under load on the railcar to provide a variable damping component to the suspension system.

18. The railcar bogie according to claim 16, wherein the first and second springs are helical compression springs, the first spring in use having a substantially vertical axis and the second spring being angled at about 35 degrees to the horizontal.

19. A railcar bogie according to claim 16, wherein the bolster and the friction shoe each have respective bosses for locating within end portions of the second spring.

20. The railcar bogie according to claim 13, wherein the bolster further comprising a housing in which the friction shoe locates, the friction shoe and the housing having cooperative engaging surfaces that guide the movement of the friction shoe relative to the housing into engagement with the friction surface under the biasing force of the first and second resilient systems.

21. The railcar bogie according to claim 20, wherein the friction shoe is guided to move substantially along the second axis.

22. A railcar bogie comprising;

a bolster;

at least one wheel-mounting side frame; and a resilient damped suspension system connecting the at least one side frame to the bolster, wherein the suspension system comprises:

a friction surface disposed on the side frame;

a friction shoe displaceably mounted in the bolster for the displacement to allow frictional engagement of the friction shoe with the friction surface to provide damping to the suspension system;

a first resilient system acting between the side frame and the friction shoe; and a second resilient system acting between the bolster and the friction shoe, each of the first and second resilient systems being operative to impart a biasing force to the friction shoe bias the friction shoe into engagement with the friction surface;

wherein the first resilient system comprises a first resilient structure with a line of action along a first axis; and the second resilient system comprises a second resilient structure with a line of action along a second axis arranged at an acute angle to the first axis;

wherein the first resilient structure comprises a compression spring for mounting along the first axis and the second resilient structure comprises a second compression spring for mounting along the second axis; and wherein the biasing force imparted by the first resilient structure varies depending on the loading condition of the railcar to provide a variable damping component to the suspension system, whereas the biasing force imparted by the second resilient system is substantially constant and not dependent on the loading condition of the railcar to provide a constant damping component to the suspension system, the first and second springs of the first and second resilient structures being chosen and mounted such that when a load on the railcar bogie is at the lower end of an operating load range, the constant damping component is greater than the variable damping component, and when the load is at the upper end of the operating load range, the variable damping component is greater than the constant damping component.

23. A railcar bogie comprising;

a bolster;

at least one wheel-mounting side frame; and a resilient damped suspension system connecting the at least one side frame to the bolster, wherein the suspension system comprises:

a friction surface disposed on the side frame;

a friction shoe displaceably mounted in the bolster for displacement to allow frictional engagement of the friction shoe with the friction surface to provide damping to the suspension system;

a first resilient system acting between the side frame and the friction shoe; and a second resilient system acting between the bolster and the friction shoe, each of the first and second resilient systems being operative to impart a biasing force to the friction shoe to bias the friction shoe into engagement with the friction surface;

wherein the first resilient system comprises a first resilient structure with a line of action along a first axis; and the second resilient system comprises a second resilient structure with a line of action along a second axis arranged at an acute angle to the first axis;

wherein the first resilient structure comprises a compression spring for mounting along the first axis and the second resilient structure comprises a second compression spring for mounting along the second axis;

wherein the biasing force imparted by the first resilient structure varies depending on the loading condition of the railcar to provide a variable damping component to the suspension system, whereas the biasing force imparted by the second resilient structure is substantially constant and not dependent on the loading condition of the railcar to provide a constant damping component to the suspension system, the first and second springs of the first and second resilient structures being chosen and mounted such that when a load on the railcar bogie is at the lower end of an operating load range, the constant damping component is greater than the variable damping component, and when the load is at the upper end of the operating load range, the variable damping component is greater than the constant damping component; and wherein when the load is at the lower end of the operating range, the constant damping component is about 70% of the total damping, and wherein when the load is at the upper end of the operating range, the variable damping component is about 70% of the total damping.

* * * * *